US005437176A

United States Patent [19]

Keller

[11] Patent Number: 5,437,176

[45] Date of Patent: Aug. 1, 1995

[54] KEY AND ROTARY LOCK CYLINDER FOR SAFETY LOCK

[76] Inventor: Ernst Keller, Untere Schwandenstrasse 22, CH-8805 Richterswil, Switzerland

[21] Appl. No.: 955,244

[22] Filed: Oct. 1, 1992

Related U.S. Application Data

[63] Continuation of Ser. No. 748,160, Aug. 21, 1991, abandoned.

[30] Foreign Application Priority Data

Aug. 22, 1990 [CA] Canada ..... 2727/90
Jan. 15, 1991 [CA] Canada ..... 98/91

[51] Int. Cl.[6] ..... E05B 27/06

[52] U.S. Cl. ..... 70/358; 70/378; 70/493; 70/398; 70/409

[58] Field of Search ..... 70/358, 398, 399, 407, 70/409, 490, 492, 493, 378

[56] References Cited

U.S. PATENT DOCUMENTS

| | | | |
|---|---|---|---|
| 1,735,868 | 11/1929 | Klingel | 70/399 |
| 3,742,744 | 7/1973 | Lumme | 70/358 |
| 3,802,230 | 4/1974 | Tickett | 70/376 X |
| 4,213,316 | 7/1980 | Tietz | 70/358 |
| 4,434,636 | 9/1984 | Prunbauer | 70/358 |
| 4,667,495 | 5/1987 | Girard et al. | 70/358 |
| 4,823,575 | 4/1989 | Florian et al. | 70/493 X |
| 4,947,662 | 8/1990 | Imedio | 70/277 X |

FOREIGN PATENT DOCUMENTS

| | | | |
|---|---|---|---|
| 313864 | 5/1989 | European Pat. Off. | 70/358 |
| 2396144 | 3/1979 | France | 70/358 |
| 2492872 | 4/1982 | France | 70/409 |
| 2521201 | 8/1983 | France | 70/398 |
| 2619149 | 2/1989 | France | 70/398 |
| 354058 | 6/1922 | Germany | 70/409 |
| 1260340 | 2/1968 | Germany | 70/358 |
| 2154652 | 9/1985 | United Kingdom | 70/358 |
| 2161204 | 1/1986 | United Kingdom | 70/358 |

*Primary Examiner*—Peter M. Cuomo
*Assistant Examiner*—Suzanne L. Dino
*Attorney, Agent, or Firm*—Browdy and Neimark

[57] ABSTRACT

An additional tumbler (10) is disposed in the rotary lock cylinder, which is aligned by means of a control element (19) disposed in the key (16). A blocking element (6) is provided in the stator (2) at a distance from this tumbler (10) which, in a set rotational position of the rotor (3), radially displaces the control element (19) with the core pin (13) of the additional tumbler (10) against a restoring force.

15 Claims, 5 Drawing Sheets

KEY AND ROTARY LOCK CYLINDER FOR SAFETY LOCK

This application is a continuation of application Ser. No. 07/748,160, filed Aug. 21, 1991 and now abandoned.

The invention relates to a key and a rotary lock cylinder as well as to a key for a rotary lock cylinder with an additional tumbler.

Keys of this species have the advantage that they are difficult to duplicate in an unauthorized manner because of the control element disposed in the shaft. Thus, locking installations equipped with such keys have a higher security value. Conventional keys of this species (also called "mechanical keys") have disadvantages, so that in spite of their high degree of resistance to duplication have not been in widespread use, particularly in the form of reversible keys.

A conventional key of this type is shown in U.S. Pat. No. 4,667,495 which, this key has a pin which can be displaced to a limited degree for aligning the additional tumbler in the shaft. In the course of insertion of the shaft into the key channel, the pin runs up on a ramp disposed in the rotor, which radially displaces the pin and by this means aligns the additional tumbler. Grooves or other recesses are required on the shaft so that the ramp can reach the pin during insertion into the shaft which in a flat key limit the surface available for the control bore. In actual use it is therefore necessary to dispose the pin as closely as possible to the front end of the shaft. The loosely displaceable pin mostly protrudes from the shaft with one end, so that the key can catch there.

A key of this type is also shown in European Patent Disclosure EP-A-202 949. In this case the additional tumbler is also aligned by means of a pin which is limitedly displaceable in the key shaft, so that the above described difficulties also arise here.

Figure 1:
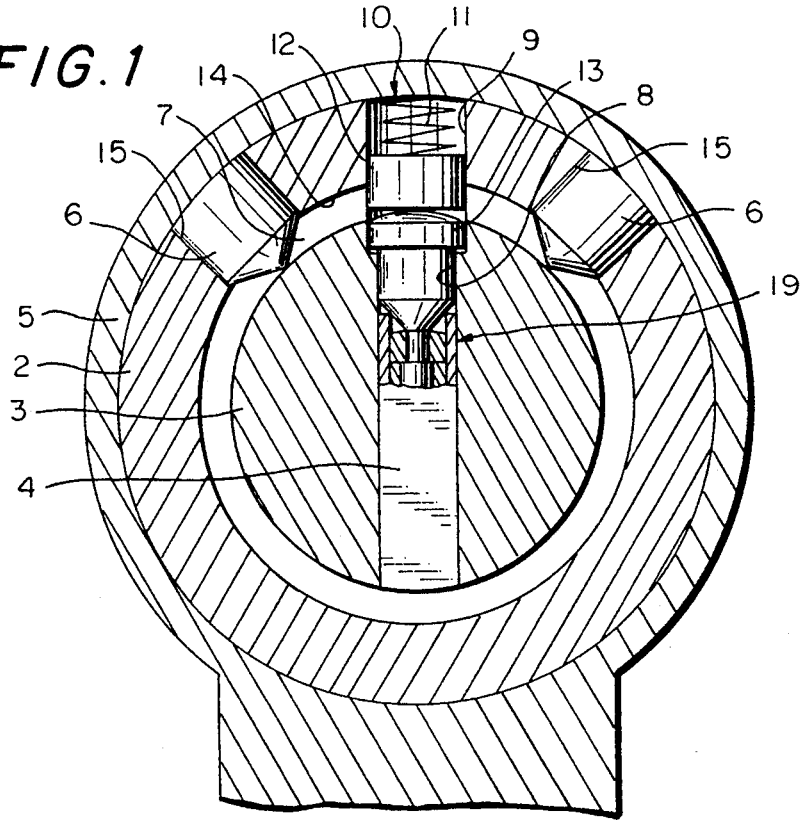
Figure 2:
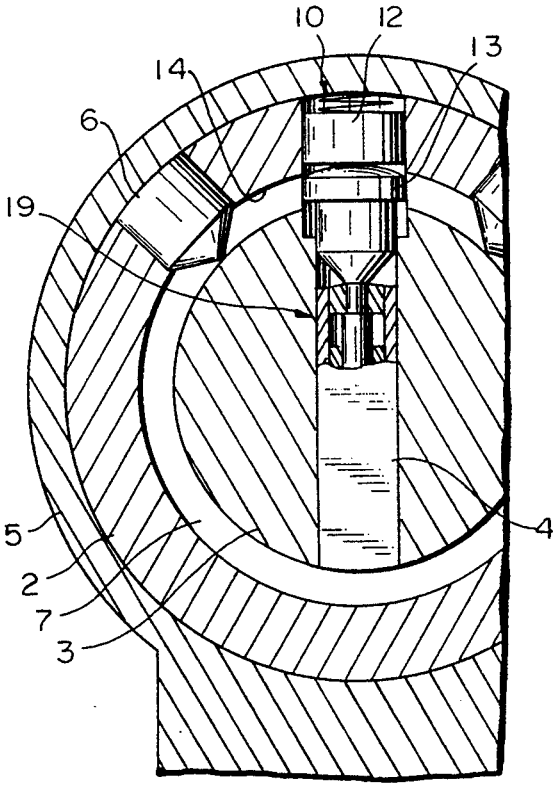
Figure 3:
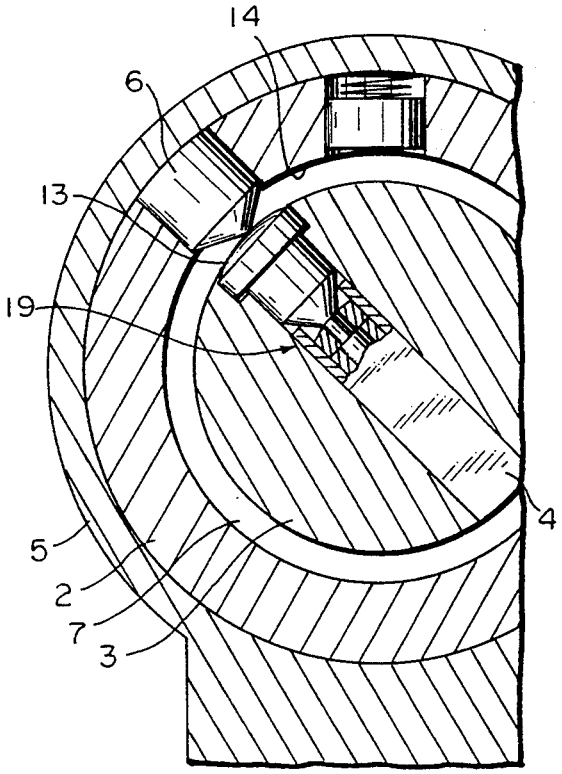
Figure 4:
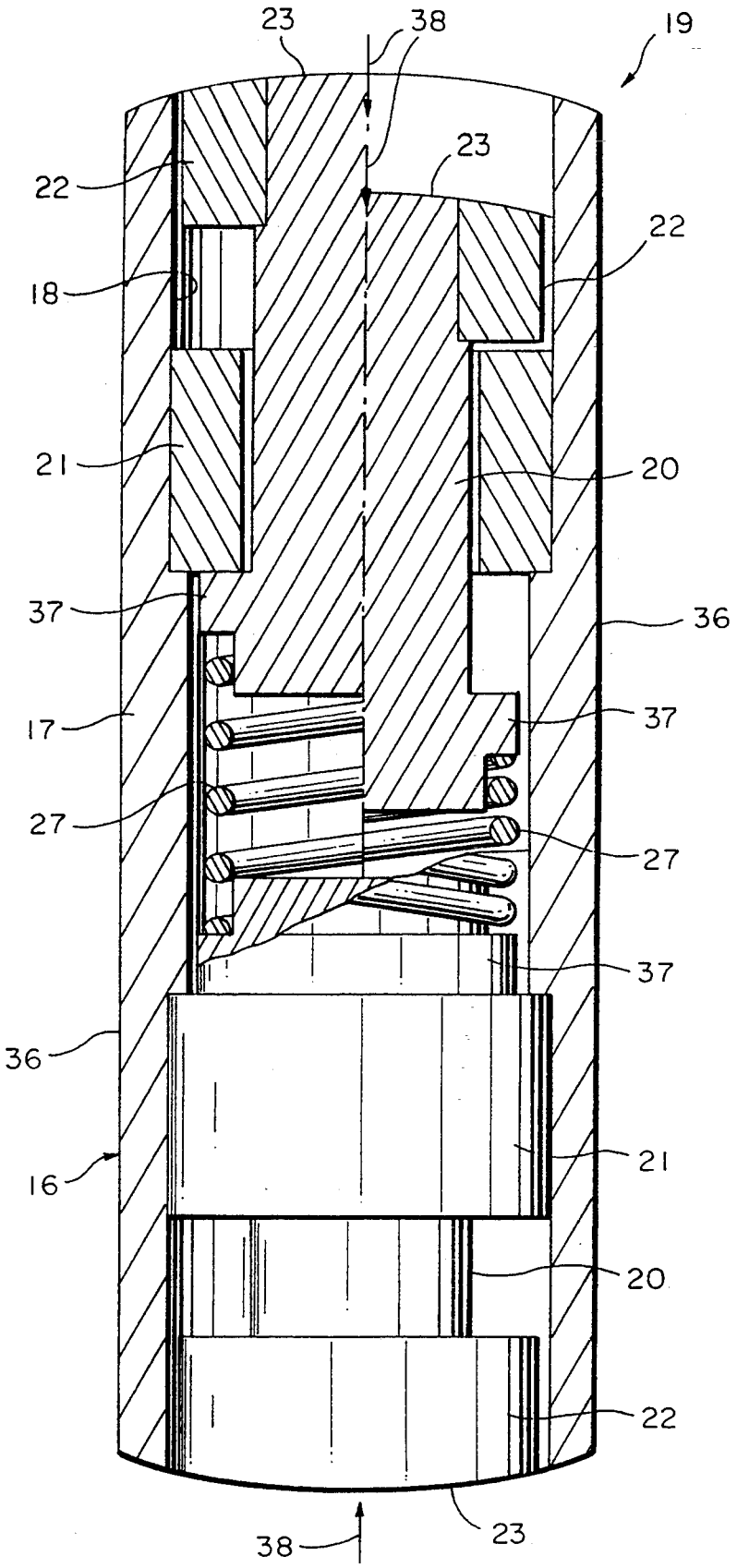
Figure 5:
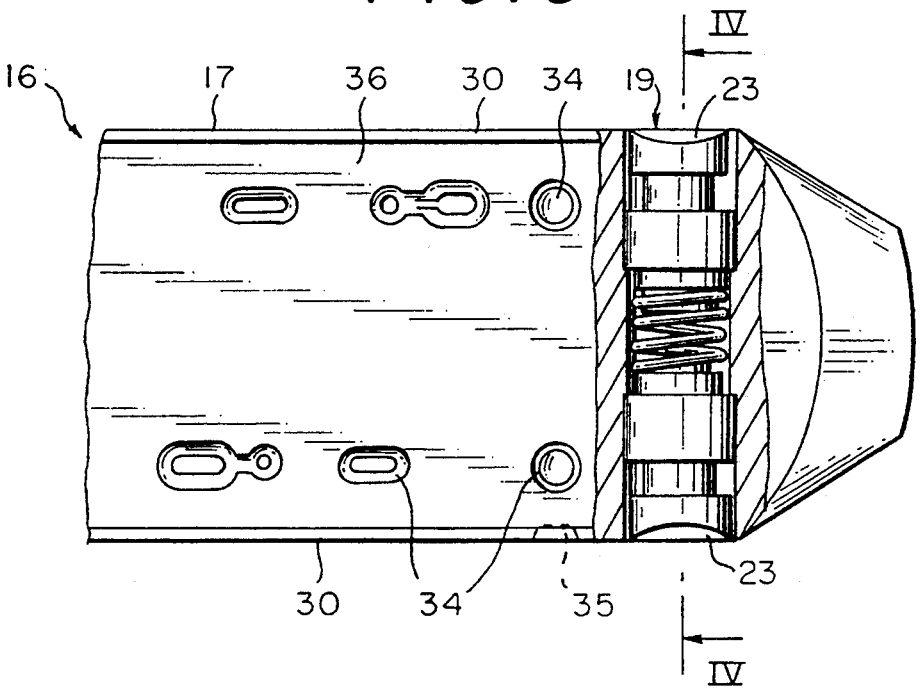
Figure 6A:
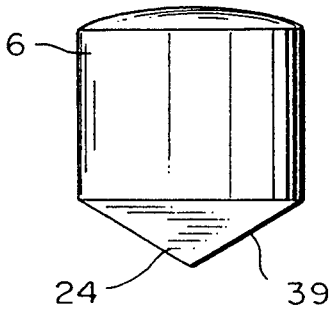
Figure 6B:
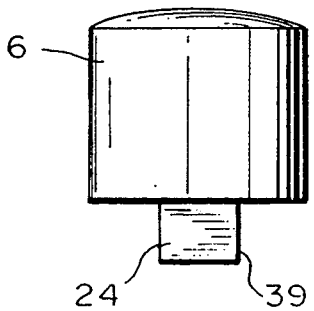
Figure 7:
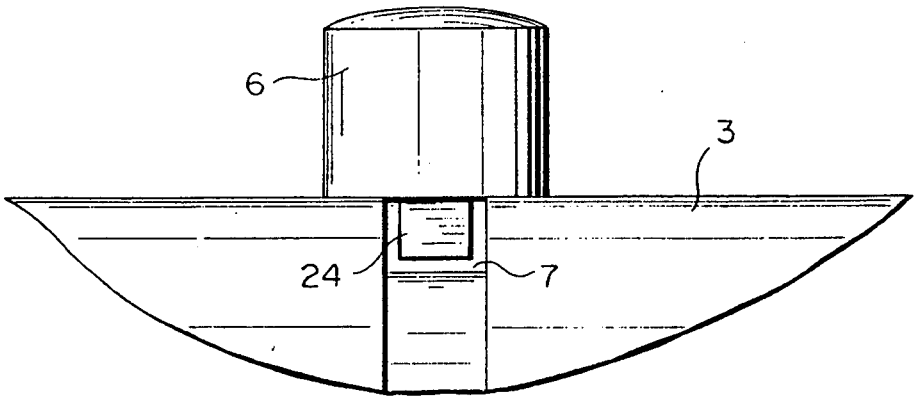
Figure 8:
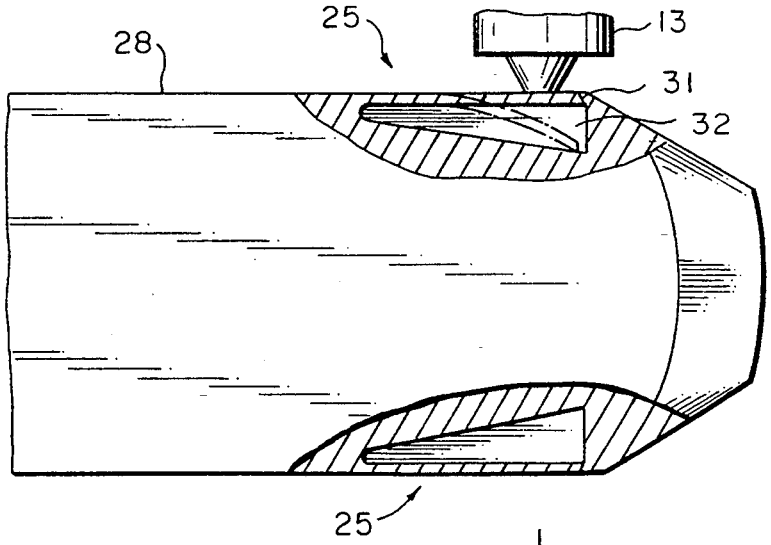
Figure 9A:
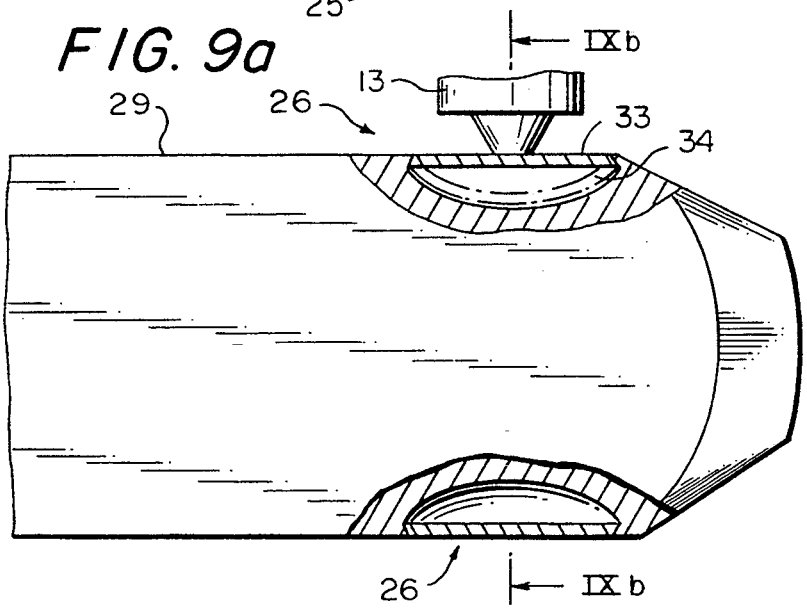
Figure 9B:
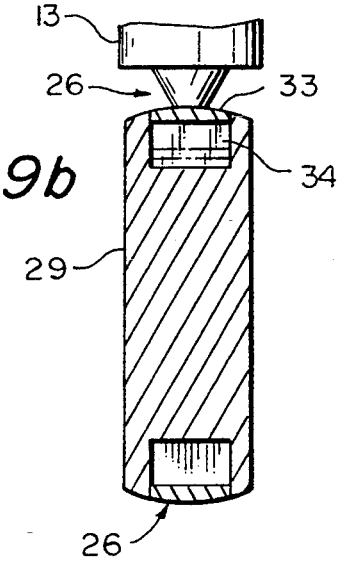

It is the object of the invention to provide a key and a rotary lock cylinder of the species mentioned which, on the outside of the shaft, does not require a recess for a ramp disposed in the rotary cylinder, but which is nevertheless easy to manufacture and extremely difficult to duplicate. It is a further object of the invention to provide a rotary lock cylinder in accordance with the invention which further increases security against manipulation. Exemplary embodiments will be described in detail below by means of the drawings. Shown are in:

FIG. 1 a sectional view of a rotary lock cylinder in accordance with the invention, FIG. 2 a sectional view of a rotary lock cylinder in accordance with the invention with a cylinder inserted, FIG. 3 the same view as in FIG. 2, but after rotation of the rotor by approximately 45°, FIG. 4 a sectional view of a key in accordance with the invention along the line IV—IV of FIG. 5, FIG. 5 a partial view of a partially cut key in accordance with the invention, FIGS. 6*a* and 6*b* views of a blocking element, FIG. 7 a partial view of a rotor and a blocking element in accordance with FIGS. 6*a* and 6*b*, FIG. 8 a partial view of a variant of a key according with the invention, FIG. 9*a* a partial sectional view of a section of a key in accordance with a third variant, FIG. 9*b* a section along the line IXb—IXb of FIG. 9*a*, FIGS. 10*a* to 10*e* sections through a rotary lock cylinder in accordance with a variant of the invention.

The rotary lock cylinder shown in FIG. 1 has, in a customary manner, a rotor 3 with a key channel 4, whose longitudinal axis is perpendicular to the circular cross section of rotor 3, a stator 2 and a steel jacket 5. By means of a reversible key introduced into the key channel 4, customary pin tumblers, not shown here, are aligned, after which the rotor 3 can be turned to operate the lock, not shown here. The associated key 16 in accordance with FIG. 5 has bores 35 on the broad and narrow sides for aligning these customary tumblers. However, the key may also be a notched key, in which case the rotary lock cylinder is of course correspondingly designed.

The rotary lock cylinder has an additional tumbler 10, which is aligned by means of the control element 19 shown in FIG. 4 which is located in key 16. This additional control element 19 is adapted to engage a core pin 13, seated in a radial bore 8 of the rotor 3, and a housing pin 12, seated in a bore 9 of the stator 2, as well as a helical spring 11 supported on the jacket 5. In the arrangement illustrated in FIG. 1, the housing pin 12 extends beyond the shear line 14 and thus blocks the rotor 3. At the same time the rotor 3 is blocked by means of other conventional pin tumblers, not shown here. As shown in FIG. 1, each blocking pin 6 has been inserted into symmetrical bores 15 of the stator 2 and are also supported on the jacket 5 and extend with their front end beyond the shear line 14. Blocking pin 6 is shown in detail in FIGS. 6*a* and 6*b*. Furthermore, FIG. 7 shows how the narrower, inner end 24 of the blocking pin 6 engages a circumferential groove 7 of the rotor 3. Thus, the blocking pin 6 can only move to a limited degree in the radial direction, because it rests against the jacket 5 with one end and against the rotor 3 with the other.

The control element 19 shown in FIGS. 4 and 5 has a continuous bore 18. This bore extends crosswise to the longitudinal direction of the shaft 17 of key 16 and parallel to the broad sides 36 of key 16. The control element 19 has two bolts 20, between which a pressure spring 27 is disposed, which has a considerably higher spring force than the spring 11 of the additional tumbler 10. The front faces 23 of the bolts 20 are flush with the narrow sides 30 of the shaft 17 of key 16 and are prevented from leaving the bore 18 by sleeves 21 inserted into the bore 18. The sleeves 21 are securely fixed in the bores 18 by means of, for example, press fitting. At radially protruding stop flanges 37 the spring 19 pushes the bolts 20 against the respective sleeve 21 secured in the bore 18. If a force greater than the spring force of the spring 27 is exerted on the bolts 20 in the direction of the arrows 38, the bolts 20 can be moved inward separately or together. This movement is limited by sleeves 22, each of which has been placed on the outer ends of the bolts 20.

The operation of the control element 19 will be described in detail below by means of FIGS. 2 and 3. The key shaft 17 is inserted in the customary manner into the key channel 4 to permit the rotation of the rotor 3. In the course of this the customary tumblers are aligned in a known manner. As shown in FIG. 2, the additional pin tumbler 10 is aligned by means of the control element 19. When so aligned the core pin 13 abuts against the front face 23 of the bolt 20 and is radially raised to the height required to release the rotor 3. Since, as already mentioned, the spring 27 is considerably stiffer than the spring 11 of the pin tumbler, the bolt 20 of the control element 19 essentially does not move during the alignment of the tumbler 10. With the tumblers all aligned, the rotor 3 with the key 16 inserted can be turned clockwise or counterclockwise. As shown, the outer end of the core pin 13 engages the circumferential groove 7 of the rotor 3.

Following a turn of approximately 45°, i.e. prior to the activation of the bolts of an associated lock, a bolt 20 of the control element 19 abuts against a blocking bolt 6. If the rotor 3 continues to be turned in the same direction of rotation, the bolt 20 is moved inwardly against a restoring force of the spring 27 by a wedge face 39 of the blocking bolt 6. Since the bolt 20 can easily move away towards the inside, the rotor 3 can continue to be turned across the blocking bolt 6 in the same direction of rotation and the bolt of the lock (not shown) can be actuated. With a key without the control element 19, the rotor 3 can only be turned as far as one of the locking bolts 6, even if the additional tumbler 10 has been aligned, because the core pin 13 cannot yield towards the interior and thus abuts against the respective blocking bolt 6.

In the embodiment of a key in accordance with the invention illustrated in FIG. 8, a control element 25 is formed by a resilient arm 31, the free end of which can yield inwardly into a recess 32 of the key shaft 28. In this case, too, the key may be a reversible key or a notched key. In the case of a reversible key, two such control elements 25 are symmetrically disposed. The resilient arm 31 is embodied in such a way that, for alignment of the additional tumbler 10, it can radially lift the core pin 13 outwardly to the required height against the force of the spring 11.

In the embodiment in accordance with FIGS. 9a and 9b, a control element 26 is formed by a resilient bar 33, covering a trough-shaped recess 34. The two ends of the resilient bar 33 are fastened in corresponding recesses of the shaft 29 or are soldered to it. In this case, too, the bar 33 is embodied in such a way that it can lift the core pin 13 to the required height to release the rotor 3, but that the core pin 13 can yield towards the interior when traversing a blocking bolt 6.

Figure 10A:
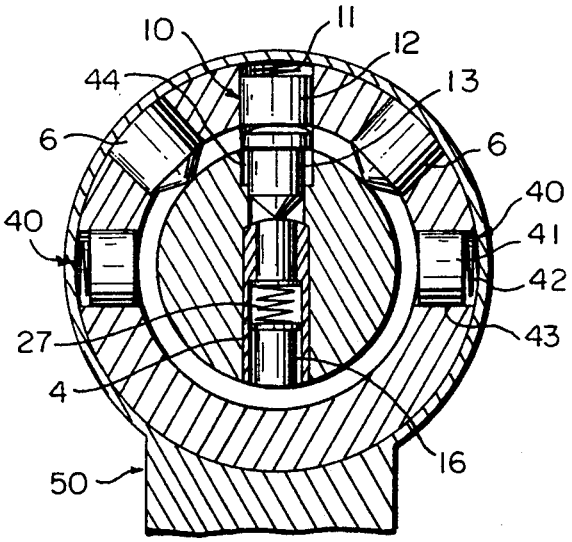
Figure 10B:
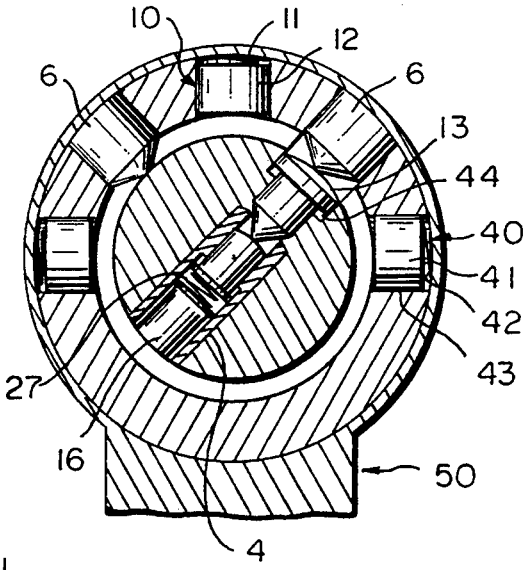
Figure 10C:
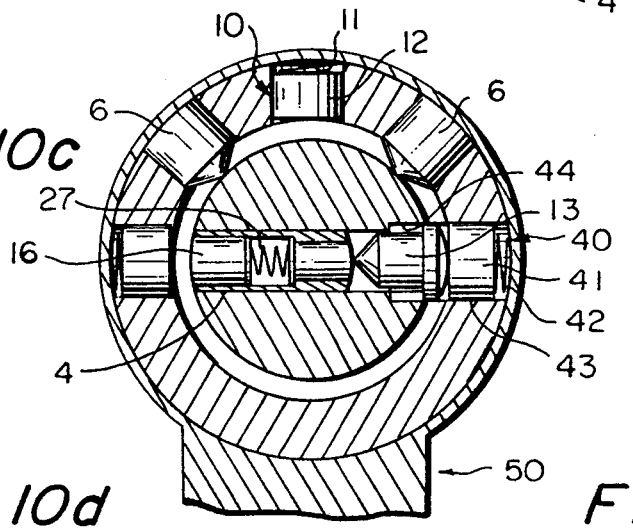
Figure 10D:
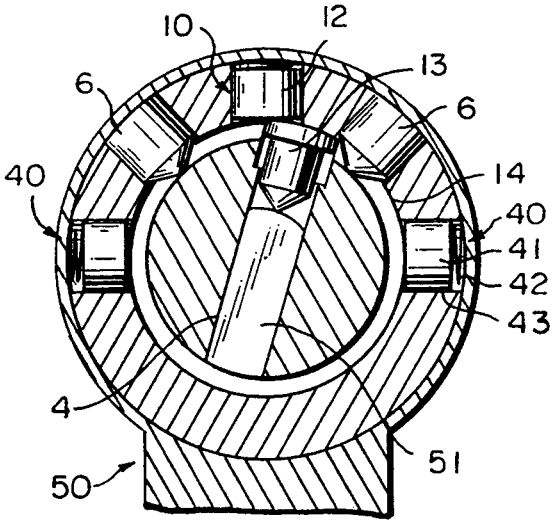
Figure 10E:
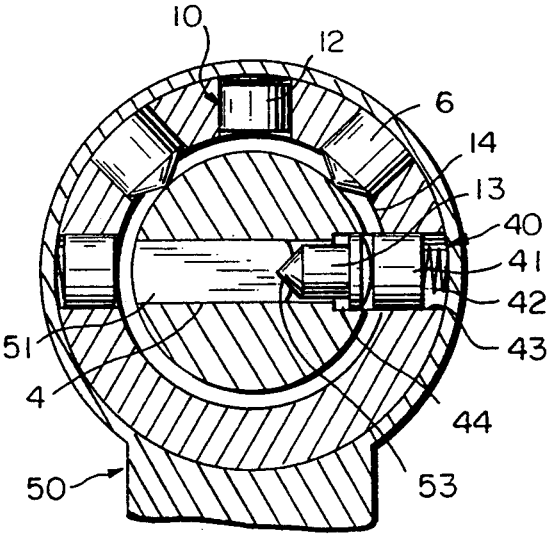

FIGS. 10*a* to 10*e* show a rotary lock cylinder 50 which can be operated by means of a key 16, described above. It is distinguished from the rotary lock cylinder 1 in that two additional tumblers 40 are disposed in the radial plane of the additional tumbler 10, each of which has a bolt 41 made of chrome nickel steel located in a radial bore 43 of the stator and which is pressed against the rotor by a pressure spring 42, which preferably is considerably stiffer than the spring 11. These additional tumblers 40 check the control element 19, 25 or 26 in order to prevent manipulation. The operation of the further tumblers 40 will be described below by means of FIGS. 10*a* to 10*c*. In the arrangement in accordance with FIG. 10*a*, the above described key 16 has been inserted into the key channel 4. The additional tumbler 10 and the customary tumblers, not shown here, are aligned, so that the rotor can be turned into the rotated position shown in FIG. 10*b* and finally in FIG. 10*c*. In the rotated position in accordance with FIG. 10*c*, the core pin 13 is pressed radially inward against a pin 20 of the control element 19 by the bolt 41 of the additional tumbler 40. Since the spring 27 is stiffer than the spring 42 of the additional tumbler 40, the rotor can be turned past this position and the lock can be opened. In the arrangement in accordance with FIG. 10*d*, a manipulating key 51 has been inserted into the key channel and it is assumed that it is possible by means of it to align the conventional tumblers and also the additional tumbler 10. It is also assumed that it is possible to move the core pin 13 radially inward into a recess 53 of the key 51 to overcome the blocking pin 6. Now, if the barrel attains a rotational position where the bores 43 and 44 are aligned, the bolt 41 is moved inwardly by the spring 42 and engages the bore 44 of the barrel, which thereby is blocked and cannot be further rotated to open the lock. FIG. 10*e* shows the arrangement where the bolts 41 has extended beyond the shear line 14 and prevents further rotation of the rotor. In this case the manipulating key 51 is also blocked and cannot be removed from the rotary lock cylinder.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A key and rotary lock cylinder for a safety lock, comprising, at least one control element (19; 25, 26) for aligning an additional tumbler (10) in a stator (2) surrounding a rotor (3) of said rotary lock cylinder, said control element located in a shaft (17) of said key (16), wherein, said control element (19, 25, 26) can be radially displaced against a restoring force, said restoring force being greater than a force of said additional tumbler (10), at least one blocking element (6) located in said stator (2) in a plane of rotation of said control element with said rotor and at a distance from said additional tumbler (10), said blocking element (6) extending beyond the shear line (14) between said stator (2) and said rotor (3), said blocking element displacing said control element against said restoring force when said rotor is rotated, wherein a set rotational position of the rotor (3) with said key, radially displaces said control element (19, 25, 26) with a core pin (13) of said additional tumbler (10) against said restoring force.

2. A key in accordance with claim 1, wherein the rotor (3) has a circumferential groove (7) which is engaged by the blocking element (6).

3. A key in accordance with claim 2, wherein the blocking element (6) has been inserted into a radial bore (15) of the stator (2).

4. A key in accordance with claim 3, wherein the blocking element (6) is a bolt.

5. A key in accordance with claim 3, wherein two blocking elements (6) are provided ahead of and behind the additional tumbler (10).

6. A key in accordance with claim 5, wherein the blocking elements (6) are offset by approximately 45° in the direction of rotation in respect to the additional tumbler (10).

7. A key for a rotary lock cylinder in accordance with claim 1, characterized in that a control element (19, 25, 26) is disposed in said shaft (27 to 29), which can be inwardly displaced crosswise to the longitudinal direction of the shaft against a restoring force.

8. A key in accordance with claim 7, wherein the control element (19) has two bolts (20), the front faces (23) of which are each flush with an outer surface (30) of said shaft (27).

9. A key in accordance with claim 8, wherein said outer surfaces are disposed on the narrow sides of the key shaft (27).

10. A key in accordance with claim 7, wherein said control element (25) has a resilient tongue (31), which can yield inwardly into a recess (32) of a key shaft (28).

11. A key in accordance with claim 7, wherein said control element (26) has a resilient bar (33), which can be inwardly displaced into a recess (34) of the shaft (29).

12. A key in accordance with claim 7, characterized in that the key is a flat or a reversible key and that two control elements (19, 25, 26) are disposed in the key shaft in a correspondingly symmetrical arrangement.

13. A rotary lock cylinder for a key having a control element (19, 25, 26) in a shaft (17), which can be inwardly displaced crosswise to the longitudinal direction of the shaft (17) against a restoring force, wherein a blocking element (6) is disposed in a stator (2), which extends beyond the shear line (14) between said stator (2) and a rotor (3), said blocking element displacing said control element against said restoring force when said rotor is rotated, following this blocking element (6) a tumbler (40) disposed in the same radial plane in said stator (2) as said control element with said rotor, said tumbler (40) corresponding to an additional tumbler (10) disposed ahead of the blocking element (6), said tumbler (40) and said additional tumbler (10) being able to radially move a core pin (13) inwardly, thereby precluding rotation of said rotor (3) within said stator (2).

14. A rotary lock cylinder in accordance with claim 13, wherein a housing pin (41) of said tumbler (40) is stressed by a pressure spring (42), which is considerably stiffer than a corresponding spring (11) of said additional tumbler (10).

15. A rotary lock cylinder in accordance with claim 14, wherein said blocking element (6) and said tumbler (40) each are disposed in the same radial plane ahead of and behind said additional tumbler (10).

* * * * *

UNITED STATES PATENT AND TRADEMARK OFFICE

CERTIFICATE OF CORRECTION

PATENT NO. : 5,437,176

DATED : August 1, 1995

INVENTOR(S) : Ernst Keller

It is certified that error appears in the above-indentified patent and that said Letters Patent is hereby corrected as shown below:

Title page, item 30 (Foreign Application Priority Data), change "[CA] Canada" to --[CH] Switzerland-- (both occurrences).

Signed and Sealed this

Twenty-sixth Day of December, 1995

*Attest:*

Bruce Lehman

BRUCE LEHMAN

*Attesting Officer*

*Commissioner of Patents and Trademarks*